US006184771B1

(12) United States Patent
Suzuki et al.

(10) Patent No.: US 6,184,771 B1
(45) Date of Patent: Feb. 6, 2001

(54) SINTERED BODY HAVING NON-LINEAR RESISTANCE CHARACTERISTICS

(75) Inventors: Hironori Suzuki, Kanagawa-ken; Hideyasu Andoh, Tokyo; Yoshiyasu Itoh, Kanagawa-ken; Hiroyoshi Narita, Kanagawa-ken; Yoshikazu Tanno, Kanagawa-ken; Toshiya Imai, Kanagawa-ken, all of (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/317,111

(22) Filed: May 24, 1999

(30) Foreign Application Priority Data

May 25, 1998 (JP) ..... 10-143505

(51) Int. Cl.[7] ..... H01C 7/10
(52) U.S. Cl. ..... 338/21; 338/20
(58) Field of Search ..... 338/20, 21

(56) References Cited

U.S. PATENT DOCUMENTS

| | | | | |
|---|---|---|---|---|
| 3,899,451 | * | 8/1975 | Ichinose et al. | 338/21 |
| 4,319,215 | * | 3/1982 | Yamazaki et al. | 338/21 |
| 4,320,379 | * | 3/1982 | Yodogawa | 338/21 |
| 4,460,497 | * | 7/1984 | Gupta et al. | 338/21 |
| 4,527,146 | | 7/1985 | Kanai et al. | 338/20 |
| 4,719,064 | | 1/1988 | Nakata et al. | 264/61 |
| 5,143,711 | * | 9/1992 | Kluge et al. | 423/593 |
| 5,231,370 | * | 7/1993 | Arnold, Jr. et al. | 338/21 |
| 5,254,816 | * | 10/1993 | Shutoh et al. | 338/21 |
| 5,422,779 | | 6/1995 | Borkowicz et al. | 361/119 |
| 5,569,495 | * | 10/1996 | Evans et al. | 427/446 |
| 5,739,742 | * | 4/1998 | Iga et al. | 338/21 |

FOREIGN PATENT DOCUMENTS

| | | |
|---|---|---|
| 0241150 | 10/1987 | (EP) . |
| 0 924 714 | 6/1999 | (EP) . |
| 57-099708 | 6/1982 | (JP) . |
| 59-117202 | 7/1984 | (JP) . |

* cited by examiner

*Primary Examiner*—Karl D. Easthom
(74) *Attorney, Agent, or Firm*—Foley & Lardner

(57) ABSTRACT

A sintered body which can be formed into a resistor having a non-linear resistance includes zinc oxide is the principal composition and bismuth, cobalt, antimony, manganese and nickel respectively converted to expressed $Bi_2O_3$, $Co_2O_3$, $Sb_2O_3$, MnO and NiO as auxiliary compositions. The compositions contains 0.05 to 10 mol % of $Bi_2O_3$, 0.05 to 10 mol % of $Co_2O_3$, 0.05 to 10 mol % of $Sb_2O_3$, 0.05 to 10 mol % of MnO and 0.05 to 10 mol % of NiO; the content ratio of the $Bi_2O_3$ to the NiO is in a mole ratio of 0.5 or more but 1.5 or less, and the content ratio of the MnO to the $Sb_2O_3$ is in a mole ratio of 1.0 or less. Preferably, the composition contains at least one of 0.5 to 500 ppm of aluminum, converted to $Al^{3+}$, and 10 to 1000 ppm of at least one or the other of boron and silver, converted respectively to $B^{3+}$, and $Ag^{+}$. The composition may also contain 0.01 to 1000 ppm of at least one of sodium, potassium, chlorine and calcium, converted respectively to $Na^{+}$, $K^{+}$, $Cl^{-}$ and $Ca^{2+}$.

23 Claims, 1 Drawing Sheet

SINTERED BODY HAVING NON-LINEAR RESISTANCE CHARACTERISTICS

FIELD OF THE INVENTION

The present invention relates to sintered bodies which can be used in resistors having a nonlinear resistance (hereinafter "non-linear resistors") and which include zinc oxide (ZnO) as their principal composition. In particular, the present invention relates to a non-linear resistor with superior non-linear current/voltage characteristics, and also with a greatly improved ability to withstand surge current.

DESCRIPTION OF THE RELATED ART

Generally, when abnormal voltage due to a lightning strike or lightning-like surge occurs in a power system, or when abnormal voltage due to the switching operation of an electronic equipment circuit (i.e., switching surge) occurs, a lightning arrester or a surge absorber is installed to protect the power system or the electronic equipment from the abnormal voltage. The lightning arrester or the surge absorber, which is composed of a non-linear resistor having a sintered body, on the one hand exhibits an insulating property under normal voltages, but exhibits a low resistance property when an abnormal voltage is applied. These lightning arresters or surge absorbers, are installed between a terminal of the equipment to be protected, or between the bus-line of the power system, and a ground. If abnormal voltage of a specified value or higher is generated by the lightning strike or the like, a discharge begins through the arrester and the abnormal voltage is limited by the discharge current flowing to the ground. Then, when the voltage returns to normal, the discharge immediately ceases, and the arrester returns to its former insulated state.

As disclosed in, for example, JAPANESE KOUKAI Patent PS 59-117202 Publication, the non-linear resistors that are part of the above-mentioned lightning arresters, etc., are produced by the following process. A raw material mixture is prepared by combining specified quantities of oxide powders such as $Bi_2O_3$, $Sb_2O_3$, $Co_2O_3$, MnO and $Cr_2O_3$, as auxiliary compositions, with zinc oxide (ZnO) powder, as the principal composition. After these raw material mixtures have been mixed together with water and an organic binder, a granulated powder is prepared using a spray drier or like. Then, after the granulated powder has been molded into a specified shape, a sintered body having non-linear property is produced by heating to remove the binder and sintering.

Then, as shown in FIG. 1, the essential components of a lightning arrester or the like are formed by forming a high-resistance layer (i.e., side insulating layer) 2 on the side surface of a sintered body 1, which is the above-mentioned resistor, by coating and re-baking an insulating material to prevent creeping flash-over (see FIG. 2). Then respective electrodes 3 are added after polishing the two end surfaces of the sintered body 1.

In recent years, the production of equipment structures that are part of smaller and higher performance electrical transmission and conversion facilities has progressed in order to reduce transmission costs in power systems. In order to make transmission and conversion equipment smaller and of higher performance, it is desirable to reduce the requirement for dielectric strength by improving the current/voltage non-linear characteristics of non-linear resistors, which are construction components, and to reduce the residual voltage of lightning arresters.

In particular, with lightning arresters, there is a need for designing lightning arresters smaller by increasing the surge current withstand of the non-linear resistor on the one hand, and by reducing the dimensions, e.g., height, of the non-linear resistor. However, there is the problem that, with the non-linear resistor having the prior art composition, the current/voltage non-linear characteristics and surge current withstand are still insufficient.

SUMMARY OF THE INVENTION

It is an object of the invention to provide a sintered composition which can be formed into a resistor having a non-linear resistance characteristic and overcomes the disadvantages of the related art described above.

It is a further object of the present invention provide a resistor having a non-linear resistance that has superior current/voltage non-linear characteristics and, at the same time, is capable of greatly improving the withstand-voltage property.

There has been provided according to one aspect of the present invention, a sintered body which includes: zinc oxide; and bismuth, cobalt, antimony, manganese and nickel expressed as $Bi_2O_3$, $Co_2O_3$, $Sb_2O_3$, MnO and NiO, and containing 0.05 to 10 mol % of $Bi_2O_3$, 0.05 to 10 mol % of $Co_2O_3$, 0.05 to 10 mol % of $Sb_2O_3$, 0.05 to 10 mol % of MnO and 0.05 to 10 mol % of NiO as auxiliary compositions. The content ratio of $Bi_2O_3$ to NiO is in a mole ratio of 0.5 or more but 1.5 or less. The content ratio of MnO to $Sb_2O_3$ is in a mole ratio of 1.0 or less. In a preferred embodiment, the sintered body has a non-linear electrical resistance characteristic.

According to another aspect of the invention, there has been provided a non-linear resistor which is formed from a sintered body. The non-linear resistor includes: zinc oxide as a principal composition; and bismuth, cobalt, antimony, manganese and nickel respectively converted to $Bi_2O_3$, $Co_2O_3$, $Sb_2O_3$, MnO and NiO, and containing 0.05 to 10.0 mol % of $Bi_2O_3$, 0.05 to 10 mol % of $Co_2O_3$, 0.05 to 10 mol % of $Sb_2O_3$, 0.05 to 10 mol % of MnO and 0.05 to 10 mol % of NiO as auxiliary compositions. The content ratio of $Bi_2O_3$ to NiO is in a mole ratio of 0.5 or more but 1.5 or less. The content ratio of MnO to $Sb_2O_3$ is in a mole ratio of 1.0 or less.

According to still another aspect of the invention, there has been provided a protection instrument, which protects electrical equipment from a abnormal voltage. The protection instrument includes: a first terminal connected to the electrical equipment; the non-linear resistor described above; and a second terminal connected between the non-linear resistor and a ground.

According to yet another aspect of the invention, there has been provided a method for manufacturing a sintered body described above, which includes: mixing to $Bi_2O_3$, NiO, $Sb_2O_3$, MnO, and $Co_2O_3$, as auxiliary compositions, with ZnO powder to obtain a mixture; reducing the viscosity of the mixture; spraying the mixture after reducing viscosity to obtain a granular powder; pressing the granular powder into a mold by pressure to form a molded body; heating the molded body to remove the binder; and sintering the molded body by sintering at a temperature higher than the temperature of removing the binder to obtain the sintered body.

In a preferred embodiment, the sintered body contains 0.5 to 500 ppm of aluminum, converted to $Al^{3+}$, as an auxiliary composition. Moreover, it is also desirable that 10 to 1000 ppm of at least one or the other of boron and silver, converted respectively to $B^{3+}$ and $Ag^{+}$, is contained as an auxiliary composition.

Also, the sintered body may preferably contain 0.01 to 1000 ppm of at least one of sodium, potassium, chlorine and calcium, converted respectively to $Na^+$, $K^+$, $Cl^-$ and $Ca^{2+}$, as an auxiliary composition.

BRIEF DESCRIPTION OF THE DRAWINGS

A more complete appreciation of the invention and many of the attendant advantages thereof will be readily apparent and better understood by reference to the following detailed description when considered in connection with the accompanying drawings.

DETAILED DESCRIPTION OF THE PREFERRED EMBODIMENTS

Figure 1:
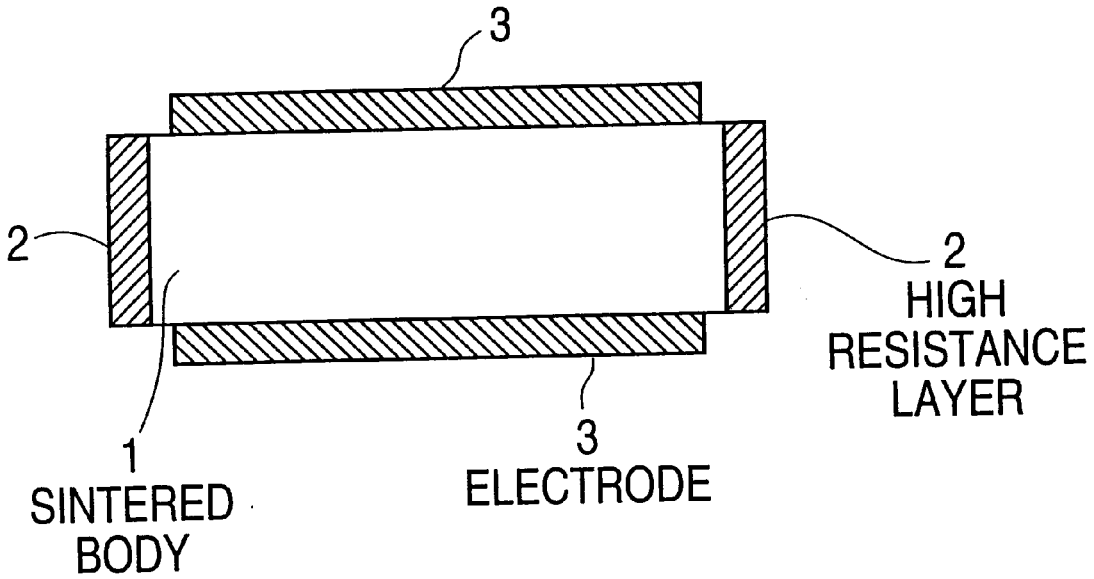
FIG. 1 shows a cross-section showing a non-linear resistor in which electrodes and a side insulation layer are formed on a non-linear resistor.
Figure 2:
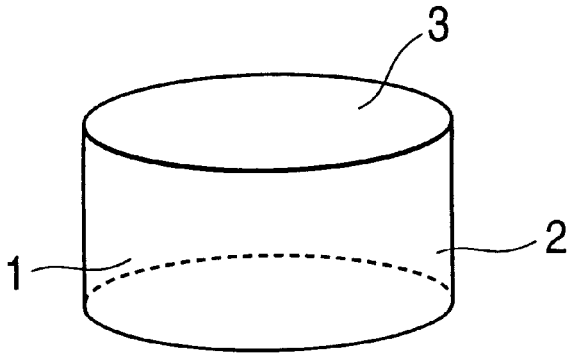
FIG.2 shows a perspective side view of a non-linear resistor in which electrodes and a side insulation layer are formed on a sintered body.

The present invention is broadly directed to sintered bodies which are preferably used in resistors having non-linear resistance.

The performance of a resistor having non-linear resistance is generally defmed by measuring the breakdown voltage.

Then, for each non-linear resistance element, the breakdown voltage (i.e., the value that current starts flowing by reduction of the electrical resistance following an increase in voltage) is measured and, at the same time, the voltage/current non-linear property is evaluated. Here, the breakdown voltage is measured as the discharge initiation voltage when a current of $1_{mA}$ is switched ON, while the voltage/current non-linear characteristics is shown by the value of the ratio shown in Equation (1) below.

Equation 1 (1)

$$V_{10kA} / V_{1mA} = \frac{V\,(\text{Voltage when } V_{10kA} \text{ current switched ON})}{V\,(\text{Voltage when } V_{1mA} \text{ current switched ON})}$$

A relatively small value of $V_{10kA}/V_{1mA}$ indicates that non-linear characteristic is excellent. In other words, the small value of this ratio means that the non-linear characteristic is excellent.

Here, $V_{10kA}$ means a residual voltage, and $V_{1mA}$ means a varistor voltage. In general, these current values are used to evaluate the non-linear characteristic of the non-linear resistor. A large value of $V_{10kA}$ means a maximum voltage that the protection instrument, such as the lighting arrester and surge absorber, can protect electrical equipment from abnormal voltage. Also, a large value of $V_{10kA}$ means the strength of the non-linear resistance is higher to mechanical destruction by the abnormal voltage.

The resistors of the present invention preferably have a varistor voltage of >400(v/mm), and more preferably >600 (v/mm); and a ratio of $V_{10kA}$:$V_{1kA}$ of <1.5, more preferably <1.4.

The composition of the sintered body includes ZnO as the principal composition (i.e., component) and bismuth (Bi), cobalt (Co), antimony (Sb), manganese (Mn) and nickel (Ni), as auxiliary compositions (i.e., components).

In the present invention, "principal composition" is defmed as the amount of ZnO present such that the total amount of ZnO and the auxiliary compositions are 90 mol % of the total composition after sintering, preferably 95 mol %, more preferably 98 mol %, most preferably 100 mol %. Minor amounts of impurities which do not substantially adversely effect the performance of the resistor made from the sintered body may also be present.

As noted above, the total composition which forms the sintered body also includes auxiliary compositions.

With the above non-linear resistor relating to the present invention, the reason for the contents of bismuth (Bi), cobalt (Co), antimony (Sb), manganese (Mn) and nickel (Ni), as auxiliary compositions, converted respectively to $Bi_2O_3$, $Co_2O_3$, $Sb_2O_3$, MnO, and NiO, being in the range of 0.05 to 10 mol %, preferably, 0.05 to 10.0 mol %, respectively, is that, outside the above range, the non-linear resistance property and life property deteriorate. Here, life property means a characteristic that the leakage current is at a stable low level over a long period of time.

Of the above auxiliary compositions, in particular, $Bi_2O_3$ is a composition that manifests non-linear resistance by being present on the grain boundaries. $Co_2O_3$ is also effective for greatly improving non-linear resistance by going into solid solution with ZnO, which is the principal composition. $Sb_2O_3$ contributes to the improvement of the varistor voltage and the surge current-resistant capacity by forming spinel. MnO also improves the non-linear resistance by going into solid solution in the ZnO and the spinel, while NiO is also an effective composition for improving non-linear resistance and the life property.

Also, by making the content ratio of $Bi_2O_3$ to NiO a mole ratio of 0.5 or more but 1.5 or less, and the content ratio of MnO to $Sb_2O_3$ a mole ratio of 1.0 or less, it becomes possible to improve the non-linear resistance property and the life property. At the same time, the moisture resistance property of the non-linear resistor can also be improved simultaneously, and a stable varistor property can be obtained over a long period. In particular, a MnO/$Sb_2O_3$ ratio of 0.9 or less is even more desirable.

Next, the manufacturing of the non-linear resistor will be explained hereinbelow.

These materials which form the principle and auxiliary compositions as well as water, organic dispersing agent, and binders are put into a mixer and then mixed and spray dried into granulated powders. Then, such granulated powders are filled in a mold to be pressed, so that a disk-shaped molding is formed. Then, a pressed body is heated to remove the binder and then sintered to form the sintered body at temperatures known to those skilled in the art.

The following are descriptions in more concrete terms of preferred embodiments of the present invention, with reference to the below-mentioned embodiments and comparative examples.

EMBODIMENT 1

Raw material mixtures were prepared by weighing and mixing specified quantities of $Bi_2O_3$, NiO, $Sb_2O_3$, MnO and $Co_2O_3$, as auxiliary compositions, with ZnO powder, as the principal composition such that the auxiliary composition contents in the ultimately obtained non-linear resistor became the values shown in Table 1 to Table 6. ZnO is the balance of the mol %. Uniform slurries were respectively prepared by adding water, dispersion material and polyvinyl alcohol (PVA), as an organic binder, to the obtained raw material mixtures and placing in mixers. Next, granular powders of grain diameter 100 $\mu$m were prepared by spray granulation of the obtained slurries with a spray drier.

The obtained granulated powders were respectively formed into disc-shaped moldings by pressure molding using a die press. Then, the molded bodies had the binder removed by heating in air at 500° C. and, after the organic binder, etc., had been eradicated, they are were sintered in air at a temperature of 1200° C. for 2 hours. Non-linear resistor test samples of diameter 20 mm×thickness 2 mm were respectively prepared by performing a grinding process on the surfaces of the obtained sintered bodies.

Then, as shown in FIG. 1, a high-resistance layer (side insulation layer) 2 is formed on the side surface of a non-linear resistor 1 for each test sample by coating a high-resistance insulating substance composed of a thermosetting resin and then baking. Next, the non-linear resistor is produced by forming respective electrodes 3 by polishing the two end surfaces of a sintered body 1 and flame-coating aluminum on these two end surfaces.

The breakdown voltage and non-linear characteristics measurement results for each non-linear resistance element are shown in Table 1 to Table 6. Tables 1 to 3 show the effect on breakdown voltage and non-linear characteristics when the contained quantities of auxiliary compositions $Bi_2O_3$, NiO, $Sb_2O_3$, MnO and $Co_2O_3$ are changed. On the other hand, Tables 4 to 6 show the effect on breakdown voltage and non-linear characteristics when the content ratio of $Bi_2O_3$ and NiO is changed.

As is clear from the results shown in Tables 1 to 6, most compositions using non-linear resistor relating to this embodiment, proved to have preferred high breakdown voltages of 600 V/mm or higher and to possess superior surge current withstand. Here, the meaning of the breakdown voltage is the same as the varistor voltage. Also, the $V_{10kA}/V_{1mA}$ values, which indicate the current/voltage non-linear characteristics, displayed superior values compared to the prior art examples, becoming 1.50 or less, preferably 1.40 or less. Thus, the present invention demonstrates that it is possible to increase the amount of surge current that can be withstood and, in particular, that the sintered body of the present invention may also be used effectively in small lightning arresters as surge absorbers.

Next, in further embodiments the effect that the addition and amount of $Al^{3+}$, $B^{3+}$ $Ag^{+}$, $Na^{+}$, $K^{+}$, $Cl^{-}$ and $Ca^{2+}$, selectively added to a non-linear resistor, exert on the breakdown voltage and non-linear characteristics of the non-linear resistor are explained based on the description of Embodiment 2 and Embodiment 3.

EMBODIMENT 2

In the embodiment of the present invention, the resistor having non-linear resistance can contain one or more of $Al^{3+}$ generally in an amount of from 0.5. to 500 ppm, $B^{3+}$ generally in an amount of from 10 to 1000 ppm and $Ag^{+}$ generally in an amount of from 10 to 1000 ppm.

A raw material mixture was prepared by mixing a specified quantity of each of $Bi_2O_3$, NiO, $Sb_2O_3$, MnO and $Co_2O_3$, as auxiliary compositions, into ZnO powder, as the principal composition such that a non-linear resistor had a basic composition containing 0.6 mol % of $Bi_2O_3$, 1.0 mol % of $Co_2O_3$, 1.0 mol % of $Sb_2O_3$, 0.9 mol % of MnO and 0.4 mol % of NiO. Then, a uniform slurry is prepared by mixing water with this raw material mixture.

First, specified quantities of an aqueous solution of aluminum nitrate were added to the above slurry such that aluminum converted to $Al^{3+}$, contained as an auxiliary composition in the non-linear resistor, were in the respective contents shown in Table 7. Then, raw material slurries were prepared by adding dispersion materials and organic binders, and mixing in mixers. Thereafter, non-linear resistor Test Samples 128 to 135 were respectively prepared by performing granulation, pressure-molding, removing the binder and sintering, following the same production method as for Embodiment 1.

Second, specified quantities of an aqueous solution of boric acid were added to the above slurry such that boron converted to $B^{3+}$ contained as an auxiliary composition in the non-linear resistor, were in the respective contents shown in Table 7. Then, raw material slurries were prepared by adding dispersion materials and organic binders, and mixing in mixers. Thereafter, non-linear resistor Test Samples 136 to 142 were respectively prepared by performing granulation, pressure-molding, removing the binder and sintering, following the same production method as for Embodiment 1.

Third, specified quantities of an aqueous solution of silver nitrate were added to the above slurry such that silver converted to $Ag^{+}$ contained as an auxiliary composition in the non-linear resistor, were in the respective contents shown in Table 7. Then, raw material slurries were prepared by adding dispersion materials and organic binders, and mixing in mixers. Thereafter, non-linear resistor Test Samples 143 to 149 were respectively prepared by performing granulation, pressure-molding, heating to remove the binder and sintering, following the same production method as for Embodiment 1.

Table 7 below shows the results of measuring breakdown voltages and non-linear resistance characteristics following the same measurement methods as for Embodiment 1 and using the non-linear resistor of Test Samples 128 to 149, prepared in the above way.

As is clear from the results shown in Table 7, it has been possible to confirm that the non-linear resistor relating to this embodiment that contained $A^{3+}$, $B^{3+}$ or $Ag^{+}$ within the preferred ranges, compared with the resistor outside the above ranges, obtained relatively high values for breakdown voltage of 600 V/mm or higher, and possessed superior surge current withstand. Also, it is shown that the $V_{10kA}/V_{1ma}$ values that indicate the current/voltage non-linear characteristics are considerably improved, becoming 1.40 or less.

In other words, at the same time, $Al^{3+}$ is a composition that can greatly improve the non-linear resistor by the addition of a relatively small quantity, preferably 0.5 to 500 ppm. If the content exceeds 500 ppm, it will, on the contrary, cause the non-linear resistance to deteriorate, and thus would not be as preferable. Because improvements in properties can be obtained with an extremely small quantity of the $Al^{3+}$ composition, it is preferable to add it to, and mix it with, the raw material system as an aqueous solution of a compound that is readily soluble in water, such as a nitrate.

Also, with regard to the basic composition disclosed in the first embodiment, by the inclusion of a small amount, preferably 10 to 1000 ppm respectively, of at least one or more of boron (B) and silver (Ag), converted to $B^{3+}$ and $Ag^{+}$ it is possible to improve non-linear resistance and the life property. Direct current (DC) life, in particular, greatly improves. That is to say, a resistor made from the basic compositions alone, while useful, has the disadvantages in which the leak current increases with the passage of time when DC is applied, thermal runaway occurs, and use for DC is generally not desirable. However, by the inclusion of 10 to 1000 ppm of at least one or both of boron (B) and silver (Ag), converted to $B^{3+}$ and $Ag^{+}$ the variation with time of the leak current reduces, and therefore the DC life property improves dramatically. Here, the DC life property means the property of the non-linear resistance when the current applied to the non-linear resistor is DC. If the content is less than 10 ppm, no effect of the addition is exhibited, but by adding 10 ppm or more, the DC life property, in particular, improves. On the other hand, if the content exceeds 1000 ppm, on the contrary, not only will the DC life property deteriorate, the deterioration will also extend to the AC life and the non-linear property. Thus, a preferred aspect of the invention includes 10 to 1000 ppm of one or more of $B^{3+}$ and $Ag^{+}$.

EMBODIMENT 3

A raw material mixture was prepared by mixing a specified quantity of each of $Bi_2O_3$, $Co_2O_3$, $Sb_2O_3$, MnO and NiO, as auxiliary compositions, into ZnO powder, as the principal composition such that the non-linear resistor should have a basic composition containing 0.6 mol % of $Bi_2O_3$, 1.0 mol % of $Co_2O_3$, 1.0 mol % of $Sb_2O_3$, 0.9 mol % of MnO and 0.4 mol % of NiO. Then, a uniform slurry was prepared by mixing water with this raw material mixture.

First, specified quantities of an aqueous solution of sodium hydroxide were added to the above slurry such that sodium converted to $Na^{+}$ contained as an auxiliary composition in the non-linear resistor, was in the respective contents shown in Table 8. Then, raw material slurries were prepared by adding dispersion materials and organic binders, and mixing in mixers. Thereafter, non-linear resistor Test Samples 150 to 157 are respectively prepared by performing granulation, pressure-molding, heating to remove the binder and sintering, following the same production method as for Embodiment 1.

Second, specified quantities of an aqueous solution of potassium hydroxide were added to the above slurry such that the potassium converted to $K^{+}$ contained as an auxiliary composition in the non-linear resistor were in the respective contents shown in Table 8. Then, raw material slurries were prepared by adding dispersion materials and organic binders, and mixing in mixers. Thereafter, non-linear resistor Test Samples 158 to 165 were respectively prepared by performing granulation, pressure-molding, heating to remove the binder and sintering, following the same production method as for Embodiment 1.

Third, specified quantities of an aqueous solution of dilute hydrochloric acid were added to the above slurry such that the chlorine converted to $Cl^{-}$ contained as an auxiliary composition in the non-linear resistor, was in the respective contents shown in Table 8. Then, raw material slurries were prepared by adding dispersion materials and organic binders, and mixing in mixers. Thereafter, non-linear resistor Test Samples 166 to 173 were respectively prepared by performing granulation, pressure-molding, heating to remove the binder and sintering, following the same production method as for Embodiment 1.

Fourth, specified quantities of an aqueous solution of calcium hydroxide were added to the above slurry such that the calcium converted to $Ca^{2+}$ contained as an auxiliary composition in the non-linear resistor, were in the respective contents shown in Table 8. Then, raw material slurries were prepared by adding dispersion materials and organic binders, and mixing in mixers. Thereafter, non-linear resistor Test Samples 174 to 181 were respectively prepared by performing granulation, pressure-molding, heating to remove the binder and sintering, following the same production method as for Embodiment 1.

Table 8 shows the results of measuring breakdown voltages and non-linear resistance characteristics following the same measurement methods as for Embodiment 1 and using the non-linear resistance of Test Samples 150 to 181, prepared in the above way.

As is clear from the results shown in Table 8, it has been possible to confirm that the non-linear resistor relating to this embodiment that contained one or more of $Na^{+}$, $K^{+}$, $Cl^{-}$ and $Ca^{2+}$, within the preferred ranges, compared with the resistance outside the preferred ranges, obtained relatively high values for breakdown voltage of 600 V/mm or higher, and possessed superior surge current withstand. Also, it is shown that the $V_{10kA}/V_{1mA}$ values that indicate the current/voltage non-linear characteristics are considerably improved, becoming 1.40 or less.

In the above Embodiment 2 and Embodiment 3, the descriptions have been given taking as examples non-linear resistor having basic compositions such that they contain 0.6 mol % of $Bi_2O_3$, 1.0 mol % of $Co_2O_3$, 1.0 mol % of $Sb_2O_3$, 0.9 mol % of MnO and 0.4 mol % of NiO as auxiliary compositions. However, it has been confirmed that results in which the non-linear resistance characteristics and the surge current withstand are improved are also obtained with non-linear resistor that contain bismuth, cobalt, antimony, manganese and nickel respectively converted to $Bi_2O_3$, $Co_2O_3$, $Sb_2O_3$, MnO and NiO as 0.05 to 10.0 mol % of $Bi_2O_3$, 0.05 to 10.0 mol % of $Co_2O_3$, 0.05 to 10.0 mol % of $Sb_2O_3$, 0.05 to 10.0 mol % of MnO and 0.05 to 10.0 mol % of NiO; the content ratio of $Bi_2O_3$ to the said NiO being in a mole ratio of 0.5 or more but 1.5 or less, and the content ratio of MnO to $Sb_2O_3$ being in a mole ratio of 1.0 or less.

In other words, sodium (Na), potassium (K), chlorine (Cl) and calcium (Ca), of which at least one is selectively added as an auxiliary composition, are also effective for improving the non-linear property and the life property, and they are included within the preferred ranges of 0.01 to 1000 ppm. Generally, when this content is less than 0.01 ppm, the above improvement effect reduces, while with quantities exceeding 1000 ppm, the non-linear property is, on the contrary, reduced and thus compositions outside of this range, while still within the scope of the present invention, are not as preferred.

When using the non-linear resistor relating to the present invention, as described above, it contains zinc oxide and the principal composition and bismuth, cobalt, antimony, manganese and nickel as auxiliary compositions. The content ratio of $Bi_2O_3$ to NiO is generally in the range of 0.5 to 1.5, while the content ratio of MnO to $Sb_2O_3$ is generally 1.0 or less. Therefore, it is possible to provide a non-linear resistor with a superior current/voltage non-linear resistance characteristics and also a high withstand-voltage.

As shown above by the further inclusion of specified quantities of aluminum, boron, silver, sodium, potassium, chlorine or calcium, the non-linear resistance characteristics and the surge current withstand can be further improved.

When using a non-linear resistor having the basic composition according to the present invention, it is generally desirable to make the particle diameter of the zinc oxide (ZnO) crystal grains which are the principal composition, extremely fine, for example, at 2 to 5 $\mu$m average particle size. In addition, as well as being able to make the grain size distribution of the ZnO crystal grains extremely even, a fine particle diameter permits the size of the ZnO crystal grain interface to be finer.

The resistance value of the non-linear resistor is determined by the inverse of the number of grain boundaries per unit composition, that is to say, by the grain size of the ZnO crystal grains. Therefore, by making the grain size of the ZnO crystal grains finer according to a preferred aspect of the invention, the resistance value, that is to say the withstand-voltage value, of the non-linear resistor can be raised.

Also, the current/voltage property of a non-linear resistor is manifested at the grain boundaries of the ZnO crystal grains. When using the preferred aspect of the invention of the present application, a more uniform interface is formed by the grain size distribution of the ZnO crystal grains being made uniform and the size of the interface being made finer. Therefore, the current/voltage property will improve.

In a preferred embodiment, the non-linear resistor which is formed from a sintered body, includes: zinc oxide; bismuth, cobalt, antimony, manganese and nickel expressed as $Bi_2O_3$, $Co_2O_3$, $Sb_2O_3$, MnO and NiO, and contains 1 mol % of $Bi_2O_3$, 0.75 mol % of $Co_2O_3$, 1.75 mol % of $Sb_2O_3$, 1 mol % of MnO and 1.75 mol % of NiO as auxiliary compositions. A content ratio of $Bi_2O_3$ to NiO is in a mole ratio of about 0.57, and a content ratio of MnO to $Sb_2O_3$ is in a mole ratio of about 0.57. The preferred embodiment also includes 50 ppm of aluminum converted to $Al^{3+}$ as an auxiliary composition; 200 ppm of boron converted to $B^{3+}$ as an auxiliary composition; and 200 ppm of silver converted to as an auxiliary composition.

In another preferred embodiment, the non-linear resistor which is formed from a sintered body, includes: zinc oxide; bismuth, cobalt, antimony, manganese and nickel expressed as $Bi_2O_3$, $Co_2O_3$, $Sb_2O_3$, MnO and NiO, and contains 0.5 to 2 mol % of $Bi_2O_3$, 0.25 to 1 mol % of $Co_2O_3$, 0.5 to 3 mol % of $Sb_2O_3$, 0.5 to 3 mol % of MnO and 0.5 to 3 mol % of NiO as auxiliary compositions. A content ratio of $Bi_2O_3$ to NiO is in a mole ratio of about 0.57. A content ratio of MnO to $Sb_2O_3$ is in a mole ratio of about 0.57. The preferred embodiment also includes 50 ppm of aluminum converted to $Al^{3+}$ as an auxiliary composition; 200 ppm of boron converted to $B^{3+}$ as an auxiliary composition; and 200 ppm of silver converted to $Ag^{3+}$ as an auxiliary composition.

The present invention is by no means limited to the embodiments described heretofore, and modification may be made without departing from invention.

Japanese Priority Application No. PH10-143505, filed on May 25, 1998, including the specification, drawings, claims and abstract, is hereby incorporated by reference.

TABLE 1

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 1* | 0.01 | 0.10 | 1.00 | 1.00 | 1.00 | 0.10 | 1.00 | 298 | 1.69 |
| 2 | 0.05 | 0.10 | 1.00 | 1.00 | 1.00 | 0.50 | 1.00 | 520 | 1.39 |
| 3 | 0.10 | 0.10 | 1.00 | 1.00 | 1.00 | 1.00 | 1.00 | 492 | 1.41 |
| 4* | 0.50 | 0.10 | 1.00 | 1.00 | 1.00 | 5.00 | 1.00 | 308 | 1.56 |
| 5* | 1.00 | 0.10 | 1.00 | 1.00 | 1.00 | 10.0 | 1.00 | 250 | 1.56 |
| 6* | 5.00 | 0.10 | 1.00 | 1.00 | 1.00 | 50.0 | 1.00 | 248 | 1.59 |
| 7* | 10.00 | 0.10 | 1.00 | 1.00 | 1.00 | 100.0 | 1.00 | 235 | 1.60 |
| 8* | 15.00 | 0.10 | 1.00 | 1.00 | 1.00 | 150.0 | 1.00 | 232 | 1.69 |
| 9* | 0.01 | 1.00 | 1.00 | 1.00 | 1.00 | 0.010 | 1.00 | 255 | 1.72 |
| 10* | 0.05 | 1.00 | 1.00 | 1.00 | 1.00 | 0.05 | 1.00 | 265 | 1.62 |
| 11* | 0.10 | 1.00 | 1.00 | 1.00 | 1.00 | 0.10 | 1.00 | 288 | 1.59 |
| 12 | 0.50 | 1.00 | 1.00 | 1.00 | 1.00 | 0.50 | 1.00 | 558 | 1.42 |
| 13 | 1.00 | 1.00 | 1.00 | 1.00 | 1.00 | 1.00 | 1.00 | 580 | 1.42 |
| 14* | 5.00 | 1.00 | 1.00 | 1.00 | 1.00 | 5.00 | 1.00 | 308 | 1.55 |
| 15* | 10.00 | 1.00 | 1.00 | 1.00 | 1.00 | 10.0 | 1.00 | 295 | 1.58 |
| 16* | 15.00 | 1.00 | 1.00 | 1.00 | 1.00 | 15.0 | 1.00 | 260 | 1.69 |
| 17* | 0.10 | 0.01 | 1.00 | 1.00 | 1.00 | 10.0 | 1.00 | 310 | 1.69 |
| 18* | 0.10 | 0.05 | 1.00 | 1.00 | 1.00 | 2.00 | 1.00 | 328 | 1.58 |
| 19* | 0.10 | 0.50 | 1.00 | 1.00 | 1.00 | 0.20 | 1.00 | 319 | 1.55 |
| 20* | 0.10 | 5.00 | 1.00 | 1.00 | 1.00 | 0.02 | 1.00 | 265 | 1.62 |
| 21* | 0.10 | 10.00 | 1.00 | 1.00 | 1.00 | 0.010 | 1.00 | 248 | 1.65 |
| 22* | 0.10 | 15.00 | 1.00 | 1.00 | 1.00 | 0.0067 | 1.00 | 245 | 1.72 |

*Comparative Example

TABLE 2

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 23* | 1.00 | 0.01 | 1.00 | 1.00 | 1.00 | 100.0 | 1.00 | 247 | 1.73 |
| 24* | 1.00 | 0.05 | 1.00 | 1.00 | 1.00 | 20.0 | 1.00 | 248 | 1.69 |
| 25* | 1.00 | 0.50 | 1.00 | 1.00 | 1.00 | 2.00 | 1.00 | 300 | 1.55 |
| 26* | 1.00 | 5.00 | 1.00 | 1.00 | 1.00 | 0.20 | 1.00 | 298 | 1.57 |
| 27* | 1.00 | 10.00 | 1.00 | 1.00 | 1.00 | 0.10 | 1.00 | 280 | 1.68 |
| 28* | 1.00 | 15.00 | 1.00 | 1.00 | 1.00 | 0.067 | 1.00 | 268 | 1.76 |
| 29* | 1.00 | 1.00 | 0.01 | 0.10 | 1.00 | 1.00 | 10.0 | 260 | 1.69 |
| 30* | 1.00 | 1.00 | 0.05 | 0.10 | 1.00 | 1.00 | 2.00 | 295 | 1.58 |
| 31 | 1.00 | 1.00 | 0.10 | 0.10 | 1.00 | 1.00 | 1.00 | 370 | 1.50 |
| 32 | 1.00 | 1.00 | 0.50 | 0.10 | 1.00 | 1.00 | 0.20 | 634 | 1.37 |

TABLE 2-continued

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 33 | 1.00 | 1.00 | 1.00 | 0.10 | 1.00 | 1.00 | 0.10 | 630 | 1.38 |
| 34* | 1.00 | 1.00 | 5.00 | 0.10 | 1.00 | 1.00 | 0.020 | 606 | 1.40 |
| 35* | 1.00 | 1.00 | 10.00 | 0.10 | 1.00 | 1.00 | 0.010 | 598 | 1.40 |
| 36* | 1.00 | 1.00 | 15.00 | 0.10 | 1.00 | 1.00 | 0.0067 | 580 | 1.69 |
| 37* | 1.00 | 1.00 | 0.01 | 1.00 | 1.00 | 1.00 | 100.0 | 250 | 1.73 |
| 38* | 1.00 | 1.00 | 0.05 | 1.00 | 1.00 | 1.00 | 20.0 | 290 | 1.61 |
| 39* | 1.00 | 1.00 | 0.10 | 1.00 | 1.00 | 1.00 | 10.0 | 312 | 1.59 |
| 40* | 1.00 | 1.00 | 0.50 | 1.00 | 1.00 | 1.00 | 2.00 | 332 | 1.56 |
| 41* | 1.00 | 1.00 | 5.00 | 1.00 | 1.00 | 1.00 | 0.20 | 578 | 1.39 |
| 42* | 1.00 | 1.00 | 10.00 | 1.00 | 1.00 | 1.00 | 0.10 | 570 | 1.40 |

*Comparative Example

TABLE 3

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 43* | 1.00 | 1.00 | 15.00 | 1.00 | 1.00 | 1.00 | 0.067 | 380 | 1.70 |
| 44 | 1.00 | 1.00 | 0.10 | 0.01 | 1.00 | 1.00 | 0.10 | 306 | 1.77 |
| 45 | 1.00 | 1.00 | 0.10 | 0.05 | 1.00 | 1.00 | 0.50 | 601 | 1.40 |
| 46* | 1.00 | 1.00 | 0.10 | 0.50 | 1.00 | 1.00 | 5.00 | 314 | 1.59 |
| 47* | 1.00 | 1.00 | 0.10 | 5.00 | 1.00 | 1.00 | 50.0 | 296 | 1.62 |
| 48* | 1.00 | 1.00 | 0.10 | 10.00 | 1.00 | 1.00 | 100.0 | 277 | 1.75 |
| 49* | 1.00 | 1.00 | 0.10 | 15.00 | 1.00 | 1.00 | 150.0 | 256 | 1.79 |
| 50* | 1.00 | 1.00 | 1.00 | 0.01 | 1.00 | 1.00 | 0.010 | 297 | 1.68 |
| 51 | 1.00 | 1.00 | 1.00 | 0.05 | 1.00 | 1.00 | 0.050 | 580 | 1.38 |
| 52 | 1.00 | 1.00 | 1.00 | 0.50 | 1.00 | 1.00 | 0.50 | 602 | 1.39 |
| 53* | 1.00 | 1.00 | 1.00 | 5.00 | 1.00 | 1.00 | 5.00 | 302 | 1.55 |
| 54* | 1.00 | 1.00 | 1.00 | 10.00 | 1.00 | 1.00 | 10.0 | 294 | 1.65 |
| 55* | 1.00 | 1.00 | 1.00 | 15.00 | 1.00 | 1.00 | 15.0 | 286 | 1.79 |
| 56* | 1.00 | 1.00 | 1.00 | 1.00 | 0.01 | 1.00 | 1.00 | 218 | 1.72 |
| 57 | 1.00 | 1.00 | 1.00 | 1.00 | 0.05 | 1.00 | 1.00 | 270 | 1.55 |
| 58 | 1.00 | 1.00 | 1.00 | 1.00 | 0.10 | 1.00 | 1.00 | 593 | 1.43 |
| 59 | 1.00 | 1.00 | 1.00 | 1.00 | 0.50 | 1.00 | 1.00 | 609 | 1.42 |
| 60* | 1.00 | 1.00 | 1.00 | 1.00 | 5.00 | 1.00 | 1.00 | 578 | 1.41 |
| 61* | 1.00 | 1.00 | 1.00 | 1.00 | 10.00 | 1.00 | 1.00 | 560 | 1.43 |
| 62* | 1.00 | 1.00 | 1.00 | 1.00 | 15.00 | 1.00 | 1.00 | 298 | 1.68 |

*Comparative Example

TABLE 4

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 63* | 0.1 | 1.0 | 1.0 | 0.1 | 1.0 | 0.1 | 0.1 | 260 | 1.59 |
| 64* | 0.1 | 1.0 | 1.0 | 0.2 | 1.0 | 0.1 | 0.2 | 276 | 1.59 |
| 65* | 0.1 | 1.0 | 1.0 | 0.5 | 1.0 | 0.1 | 0.5 | 277 | 1.60 |
| 66* | 0.1 | 1.0 | 1.0 | 0.8 | 1.0 | 0.1 | 0.8 | 280 | 1.60 |
| 67* | 0.1 | 1.0 | 1.0 | 0.9 | 1.0 | 0.1 | 0.9 | 290 | 1.60 |
| 68* | 0.1 | 1.0 | 1.0 | 1.2 | 1.0 | 0.1 | 1.2 | 280 | 1.65 |
| 69* | 0.1 | 1.0 | 1.0 | 1.5 | 1.0 | 0.1 | 1.5 | 275 | 1.68 |
| 70* | 0.1 | 1.0 | 1.0 | 1.8 | 1.0 | 0.1 | 1.8 | 270 | 1.70 |
| 71* | 0.1 | 1.0 | 1.0 | 2.0 | 1.0 | 0.1 | 2.0 | 266 | 1.70 |
| 72* | 0.2 | 1.0 | 1.0 | 0.1 | 1.0 | 0.2 | 0.1 | 273 | 1.59 |
| 73* | 0.2 | 1.0 | 1.0 | 0.2 | 1.0 | 0.2 | 0.2 | 289 | 1.58 |
| 74* | 0.2 | 1.0 | 1.0 | 0.5 | 1.0 | 0.2 | 0.5 | 291 | 1.59 |

TABLE 4-continued

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 75* | 0.2 | 1.0 | 1.0 | 0.8 | 1.0 | 0.2 | 0.8 | 303 | 1.59 |
| 76* | 0.2 | 1.0 | 1.0 | 0.9 | 1.0 | 0.2 | 0.9 | 305 | 1.60 |
| 77* | 0.2 | 1.0 | 1.0 | 1.0 | 1.0 | 0.2 | 1.0 | 301 | 1.60 |
| 78* | 0.2 | 1.0 | 1.0 | 1.2 | 1.0 | 0.2 | 1.2 | 298 | 1.61 |
| 79* | 0.2 | 1.0 | 1.0 | 1.5 | 1.0 | 0.2 | 1.5 | 287 | 1.62 |
| 80* | 0.2 | 1.0 | 1.0 | 1.8 | 1.0 | 0.2 | 1.8 | 281 | 1.65 |
| 81* | 0.2 | 1.0 | 1.0 | 2.0 | 1.0 | 0.2 | 2.0 | 269 | 1.65 |
| 82 | 0.5 | 1.0 | 1.0 | 0.1 | 1.0 | 0.5 | 0.1 | 625 | 1.33 |
| 83 | 0.5 | 1.0 | 1.0 | 0.2 | 1.0 | 0.5 | 0.2 | 620 | 1.34 |
| 84 | 0.5 | 1.0 | 1.0 | 0.5 | 1.0 | 0.5 | 0.5 | 612 | 1.35 |

*Comparative Example

TABLE 5

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 85 | 0.5 | 1.0 | 1.0 | 0.8 | 1.0 | 0.5 | 0.8 | 610 | 1.39 |
| 86 | 0.5 | 1.0 | 1.0 | 0.9 | 1.0 | 0.5 | 0.9 | 605 | 1.40 |
| 87* | 0.5 | 1.0 | 1.0 | 1.2 | 1.0 | 0.5 | 1.2 | 560 | 1.48 |
| 88* | 0.5 | 1.0 | 1.0 | 1.5 | 1.0 | 0.5 | 1.5 | 531 | 1.50 |
| 89* | 0.5 | 1.0 | 1.0 | 1.8 | 1.0 | 0.5 | 1.8 | 509 | 1.51 |
| 90* | 0.5 | 1.0 | 1.0 | 2.0 | 1.0 | 0.5 | 2.0 | 458 | 1.53 |
| 91 | 0.8 | 1.0 | 1.0 | 0.1 | 1.0 | 0.8 | 0.1 | 642 | 1.31 |
| 92 | 0.8 | 1.0 | 1.0 | 0.2 | 1.0 | 0.8 | 0.2 | 635 | 1.32 |
| 93 | 0.8 | 1.0 | 1.0 | 0.5 | 1.0 | 0.8 | 0.5 | 628 | 1.35 |
| 94 | 0.8 | 1.0 | 1.0 | 0.8 | 1.0 | 0.8 | 0.8 | 623 | 1.36 |
| 95 | 0.8 | 1.0 | 1.0 | 0.9 | 1.0 | 0.8 | 0.9 | 612 | 1.38 |
| 96 | 0.8 | 1.0 | 1.0 | 1.0 | 1.0 | 0.8 | 1.0 | 592 | 1.42 |
| 97* | 0.8 | 1.0 | 1.0 | 1.2 | 1.0 | 0.8 | 1.2 | 532 | 1.48 |
| 98* | 0.8 | 1.0 | 1.0 | 1.5 | 1.0 | 0.8 | 1.5 | 482 | 1.51 |
| 99* | 0.8 | 1.0 | 1.0 | 1.8 | 1.0 | 0.8 | 1.8 | 436 | 1.53 |
| 100* | 0.8 | 1.0 | 1.0 | 2.0 | 1.0 | 0.8 | 2.0 | 388 | 1.58 |
| 101 | 1.0 | 1.0 | 1.0 | 0.2 | 1.0 | 1.0 | 0.2 | 625 | 1.38 |
| 102 | 1.0 | 1.0 | 1.0 | 0.8 | 1.0 | 1.0 | 0.8 | 602 | 1.40 |
| 103 | 1.0 | 1.0 | 1.0 | 0.9 | 1.0 | 1.0 | 0.9 | 600 | 1.40 |
| 104* | 1.0 | 1.0 | 1.0 | 1.2 | 1.0 | 1.0 | 1.2 | 476 | 1.46 |
| 105* | 1.0 | 1.0 | 1.0 | 1.5 | 1.0 | 1.0 | 1.5 | 442 | 1.48 |
| 106* | 1.0 | 1.0 | 1.0 | 1.8 | 1.0 | 1.0 | 1.8 | 407 | 1.53 |

*Comparative Example

TABLE 6

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 107 | 1.0 | 1.0 | 1.0 | 2.0 | 1.0 | 1.0 | 2.0 | 375 | 1.55 |
| 108 | 1.2 | 1.0 | 1.0 | 0.1 | 1.0 | 1.2 | 0.1 | 650 | 1.37 |
| 109 | 1.2 | 1.0 | 1.0 | 0.2 | 1.0 | 1.2 | 0.2 | 648 | 1.37 |
| 110 | 1.2 | 1.0 | 1.0 | 0.5 | 1.0 | 1.2 | 0.5 | 642 | 1.37 |
| 111 | 1.2 | 1.0 | 1.0 | 0.8 | 1.0 | 1.2 | 0.8 | 615 | 1.38 |
| 112 | 1.2 | 1.0 | 1.0 | 0.9 | 1.0 | 1.2 | 0.9 | 608 | 1.40 |
| 113 | 1.2 | 1.0 | 1.0 | 1.0 | 1.0 | 1.2 | 1.0 | 598 | 1.43 |
| 114* | 1.2 | 1.0 | 1.0 | 1.2 | 1.0 | 1.2 | 1.2 | 530 | 1.48 |
| 115* | 1.2 | 1.0 | 1.0 | 1.5 | 1.0 | 1.2 | 1.5 | 478 | 1.52 |
| 116* | 1.2 | 1.0 | 1.0 | 1.8 | 1.0 | 1.2 | 1.8 | 433 | 1.58 |

TABLE 6-continued

| | Content of Auxiliary Compositions (mol %) | | | | | Ratios of Auxiliary Compositions (mol) | | Breakdown Voltage V1mA | Non-linear Characteristic V10kA/ |
|---|---|---|---|---|---|---|---|---|---|
| | $Bi_2O_3$ | NiO | $Sb_2O_3$ | MnO | $Co_2O_3$ | $Bi_2O_3$/NiO | MnO/$Sb_2O_3$ | (V/mm) | V1mA |
| 117* | 1.2 | 1.0 | 1.0 | 2.0 | 1.0 | 1.2 | 2.0 | 390 | 1.61 |
| 118 | 1.5 | 1.0 | 1.0 | 0.1 | 1.0 | 1.5 | 0.1 | 660 | 1.36 |
| 119 | 1.5 | 1.0 | 1.0 | 0.2 | 1.0 | 1.5 | 0.2 | 658 | 1.37 |
| 120 | 1.5 | 1.0 | 1.0 | 0.5 | 1.0 | 1.5 | 0.5 | 651 | 1.37 |
| 121 | 1.5 | 1.0 | 1.0 | 0.8 | 1.0 | 1.5 | 0.8 | 646 | 1.38 |
| 122 | 1.5 | 1.0 | 1.0 | 0.9 | 1.0 | 1.5 | 0.9 | 634 | 1.39 |
| 123 | 1.5 | 1.0 | 1.0 | 1.0 | 1.0 | 1.5 | 1.0 | 612 | 1.41 |
| 124* | 1.5 | 1.0 | 1.0 | 1.2 | 1.0 | 1.5 | 1.2 | 574 | 1.47 |
| 125* | 1.5 | 1.0 | 1.0 | 1.5 | 1.0 | 1.5 | 1.5 | 538 | 1.52 |
| 126* | 1.5 | 1.0 | 1.0 | 1.8 | 1.0 | 1.5 | 1.8 | 492 | 1.57 |
| 127* | 1.5 | 1.0 | 1.0 | 2.0 | 1.0 | 1.5 | 2.0 | 454 | 1.59 |

*Comparative Example

TABLE 7

| | Composition | amount (ppm) | Operating start voltage V1mA (V/mm) | Non-linear characteristic V10kA/V1mA |
|---|---|---|---|---|
| 128* | $Al^{3+}$ | 0.01 | 582 | 1.45 |
| 129* | $Al^{3+}$ | 0.1 | 643 | 1.40 |
| 130 | $Al^{3+}$ | 1 | 698 | 1.39 |
| 131 | $Al^{3+}$ | 10 | 720 | 1.39 |
| 132 | $Al^{3+}$ | 100 | 702 | 1.39 |
| 134* | $Al^{3+}$ | 1000 | 650 | 1.39 |
| 135* | $Al^{3+}$ | 10000 | 567 | 1.40 |
| 136* | $B^{3+}$ | 0.01 | 578 | 1.42 |
| 137* | $B^{3+}$ | 0.1 | 637 | 1.40 |
| 138* | $B^{3+}$ | 1 | 692 | 1.39 |
| 139 | $B^{3+}$ | 10 | 711 | 1 38 |
| 140 | $B^{3+}$ | 100 | 697 | 1.39 |
| 141 | $B^{3+}$ | 1000 | 640 | 1.39 |
| 142* | $B^{3+}$ | 10000 | 560 | 1.40 |
| 143* | $Ag^{+}$ | 0.01 | 569 | 1.41 |
| 144* | $Ag^{+}$ | 0.1 | 641 | 1.40 |
| 145* | $Ag^{+}$ | 1 | 695 | 1.39 |
| 146 | $Ag^{+}$ | 10 | 718 | 1.39 |
| 147 | $Ag^{+}$ | 100 | 709 | 1.39 |
| 148 | $Ag^{+}$ | 1000 | 653 | 1.39 |
| 149* | $Ag^{+}$ | 10000 | 559 | 1.40 |

*Comparative Example

TABLE 8

| | Composition | Content (ppm) | Operating start voltage V1mA (V/mm) | Non-linear characteristic V10kA/V1mA |
|---|---|---|---|---|
| 150* | $Na^{+}$ | 0.001 | 571 | 1.42 |
| 151 | $Na^{+}$ | 0.01 | 658 | 1.40 |
| 152 | $Na^{+}$ | 0.1 | 706 | 1.39 |
| 153 | $Na^{+}$ | 1 | 710 | 1.39 |
| 154 | $Na^{+}$ | 10 | 712 | 1.39 |
| 155 | $Na^{+}$ | 100 | 680 | 1.39 |
| 156 | $Na^{+}$ | 1000 | 662 | 1.39 |
| 157* | $Na^{+}$ | 10000 | 572 | 1.40 |
| 158* | $K^{+}$ | 0.001 | 531 | 1.40 |
| 159 | $K^{+}$ | 0.01 | 632 | 1.40 |
| 160 | $K^{+}$ | 0.1 | 689 | 1.39 |
| 161 | $K^{+}$ | 1 | 702 | 1.39 |
| 162 | $K^{+}$ | 10 | 695 | 1.39 |
| 163 | $K^{+}$ | 100 | 664 | 1.39 |
| 164 | $K^{+}$ | 1000 | 641 | 1.39 |
| 165* | $K^{+}$ | 10000 | 562 | 1.40 |
| 166* | $Cl^{-}$ | 0.001 | 528 | 1.40 |

TABLE 8-continued

| | Composition | Content (ppm) | Operating start voltage V1mA (V/mm) | Non-linear characteristic V10kA/V1mA |
|---|---|---|---|---|
| 167 | $Cl^{-}$ | 0.01 | 624 | 1.40 |
| 168 | $Cl^{-}$ | 0.1 | 678 | 1.39 |
| 169 | $Cl^{-}$ | 1 | 698 | 1.39 |
| 170 | $Cl^{-}$ | 10 | 704 | 1.38 |
| 171 | $Cl^{-}$ | 100 | 663 | 1.39 |
| 172 | $Cl^{-}$ | 1000 | 618 | 1.39 |
| 173* | $Cl^{-}$ | 10000 | 525 | 1.40 |
| 174* | $Ca^{2+}$ | 0.001 | 576 | 1.40 |
| 175 | $Ca^{2+}$ | 0.01 | 608 | 1.39 |
| 176 | $Ca^{2+}$ | 0.1 | 638 | 1.39 |
| 177 | $Ca^{2+}$ | 1 | 642 | 1.39 |
| 178 | $Ca^{2+}$ | 10 | 651 | 1.39 |
| 179 | $Ca^{2+}$ | 100 | 639 | 1.39 |
| 180 | $Ca^{2+}$ | 1000 | 620 | 1.39 |
| 181* | $Ca^{2+}$ | 10000 | 584 | 1.40 |

*Comparative Example

What is claimed is:

1. A sintered body comprising:

zinc oxide; and bismuth, cobalt, antimony, manganese and nickel expressed as $Bi_2O_3$, $Co_2O_3$, $Sb_2O_3$, MnO and NiO, and containing 0.05 to 10 mol % of $Bi_2O_3$, 0.05 to 10 mol % of $Co_2O_3$, 0.05 to 10 mol % of $Sb_2O_3$, 0.05 to 10 mol % of MnO and 0.05 to 10 mol % of NiO as auxiliary compositions, wherein a content ratio of $Bi_2O_3$ to NiO is in a mole ratio of 0.5 or more but 1.5 or less, wherein a content ratio of MnO to $Sb_2O_3$ is in a mole ratio of 1.0 or less and wherein the sintered body has a ratio $V_{10kA}/V_{1mA}<1.5$.

2. The sintered body according to claim 1, wherein:

the sintered body has a non-linear electrical resistance characteristic.

3. The sintered body according to claim 2, further comprising:

0.5 to 500 ppm of aluminum converted to $Al^{3+}$ as an auxiliary composition.

4. The sintered body according to claim 2, further comprising:

10 to 1000 ppm of boron converted to $B^{3+}$ as an auxiliary composition.

5. The sintered body according to claim 2, further comprising:

10 to 1000 ppm of silver converted to $Ag^{3+}$ as an auxiliary composition.

6. The sintered body according to claim 2, further comprising:

0.01 to 1000 ppm of sodium converted to $Na^{+}$ as an auxiliary composition.

7. The sintered body according to claim 2, further comprising:

0.01 to 1000 ppm of potassium converted to $K^{+}$ as an auxiliary composition.

8. The sintered body according to claim 2, further comprising:

0.01 to 1000 ppm of chlorine converted to $Cl^{-}$ as an auxiliary composition.

9. The sintered body according to claim 2, further comprising:

0.01 to 1000 ppm of calcium converted to $Ca^{2+}$ as an auxiliary composition.

10. A method for manufacturing a sintered body of claim 1, comprising the steps of:

mixing $Bi_2O_3$, $Co_2O_3$, $Sb_2O_3$, MnO and NiO as auxiliary compositions, with ZnO powder to obtain a mixture;

reducing the viscosity of the mixture;

spraying the mixture after reducing viscosity to obtain a granular powder;

pressing the granular powder into a mold by pressure to form a molded body;

heating the molded body to remove the binder; and sintering the molded body by sintering at a temperature higher than the temperature of removing the binder to obtain the sintered body.

11. The method according to claim 10, wherein:

the heating to remove the binder step is performed in the air at 500° C; and the sintering step is performed in the air at 1200° C for 2 hours.

12. The method according to claim 10, wherein the reducing step is performed by adding water, dispersion material and an organic binder.

13. A non-linear resistor which is formed from a sintered body, comprising:

zinc oxide as a principal composition; and bismuth, cobalt, antimony, manganese and nickel respectively converted to $Bi_2O_3$, $Co_2O_3$, $Sb_2O_3$, MnO and NiO, and containing 0.05 to 10.0 mol % of $Bi_2O_3$, 0.05 to 10 mol % of $Co_2O_3$, 0.05 to 10 mol % of $Sb_2O_3$, 0.05 to 10 mol % of MnO and 0.05 to 10 mol % of NiO as auxiliary compositions, wherein a content ratio of $Bi_2O_3$ to NiO is in a mole ratio of 0.5 or more but 1.5 or less, wherein a content ratio of MnO to $Sb_2O_3$ is in a mole ratio of 1.0 or less and wherein the sintered body has a ratio $V_{10kA}/V_{1mA}<1.5$.

14. The non-linear resistor according to claim 13, further comprising:

0.5 to 500 ppm of aluminum converted to $Al^{3+}$ as an auxiliary composition.

15. The non-linear resistor according to claim 13, further comprising:

10 to 1000 ppm of boron converted to $B^{3+}$ as an auxiliary constituent.

16. The non-linear resistor according to claim 13, further comprising:

10 to 1000 ppm of silver converted to $Ag^{3+}$ as an auxiliary constituent.

17. The non-linear resistor according to claim 13, further comprising:

0.01 to 1000 ppm of sodium converted to $Na^{+}$ as an auxiliary constituent.

18. The non-linear resistor according to claim 13, further comprising:

0.01 to 1000 ppm of potassium converted to $K^{+}$ as an auxiliary constituent.

19. The non-linear resistor according to claim 13, further comprising:

0.01 to 1000 ppm of chlorine converted to $Cl^{-}$ as an auxiliary constituent.

20. The non-linear resistor according to claim 13, further comprising:

0.01 to 1000 ppm of calcium converted to $Ca^{2+}$ as an auxiliary constituent.

21. A protection instrument, which protects electrical equipment from abnormal voltage, comprising:

a first terminal connected to the electrical equipment;

the non-linear resistor according to claim 13; and a second terminal connected between the non-linear resistor and a ground.

22. A non-linear resistor which is formed from a sintered body, comprising:

zinc oxide;

bismuth, cobalt, antimony, manganese and nickel expressed $Bi_2O_3$, $Co_2O_3$, $Sb_2O_3$, MnO and NiO, and containing 1 mol % of $Bi_2O_3$, 0.75 mol % of $Co_2O_3$, 1.75 mol % of $Sb_2O_3$, 1 mol % of MnO and 1.75 mol % of NiO as auxiliary compositions, wherein a content ratio of $Bi_2O_3$ to NiO is in a mole ratio of 0.57, wherein a content ratio of MnO to $Sb_2O_3$ is in a mole ratio of 0.57;

50 ppm of aluminum converted to $Al^{3+}$ as an auxiliary composition;

200 ppm of boron converted to $B^{3+}$ as an auxiliary composition; and 200 ppm of silver converted to $Ag^{+}$ as an auxiliary composition.

23. A non-linear resistor which is formed from a sintered body, comprising:

zinc oxide;

bismuth, cobalt, antimony, manganese and nickel expressed as and containing 0.5 to 2 mol % of $Bi_2O_3$, 0.25 to 1 mol % of $Co_2O_3$, 0.5 to 3 mol % of $Sb_2O_3$, 0.5 to 3 mol % of MnO and 0.5 to 3 mol % of NiO as auxiliary compositions, wherein a content ratio of $Bi_2O_3$ to NiO is in a mole ratio of 0.57, wherein a content ratio of MnO to $Sb_2O_3$ is in a mole ratio of 0.57;

50 ppm of aluminum converted to $Al^{3+}$ as an auxiliary composition;

200 ppm of boron converted to $B^{3+}$ as an auxiliary composition; and 200 ppm of silver converted to $Ag^{+}$ as an auxiliary composition.

* * * * *